US005450977A

United States Patent [19]

Moe

[11] Patent Number: 5,450,977

[45] Date of Patent: Sep. 19, 1995

[54] INSULATED SHIPPING CONTAINER

[76] Inventor: James S. Moe, 113 Tilltag St. #61, Balsam Lake, Wis. 54810

[21] Appl. No.: 8,615

[22] Filed: Jan. 22, 1993

[51] Int. Cl.[6] ..... H05K 9/00

[52] U.S. Cl. ..... 220/467; 220/444; 220/1.5

[58] Field of Search ..... 220/467, 444, 1.5; 361/424

[56] References Cited

U.S. PATENT DOCUMENTS

| | | | |
|---|---|---|---|
| 3,029,967 | 4/1962 | Morrison | 220/467 |
| 3,653,532 | 4/1972 | Mann | 220/467 |
| 3,968,895 | 7/1976 | Barnes, Jr. et al. | 220/1.5 |
| 3,989,329 | 11/1976 | Benford | 220/467 |
| 4,317,527 | 3/1982 | Belleville | 220/467 |
| 4,452,366 | 6/1984 | Nagai et al. | 220/1.5 |
| 4,457,142 | 7/1984 | Bucher . | |
| 4,502,293 | 3/1985 | Franklin, Jr. . | |
| 4,593,536 | 6/1986 | Fink et al. . | |
| 4,760,496 | 7/1988 | Koch | 220/467 |
| 4,761,969 | 8/1988 | Moe . | |

*Primary Examiner*—Joseph Man-Fu Moy
*Attorney, Agent, or Firm*—Bernstein & Associates

[57] ABSTRACT

A refrigerated shipping container is disclosed. The container has a rigid support structure surrounding the walls thereof. The floor, roof, endwall, door assemblies and sidewalls are made from a light, non-metal, highly insulative material. These components generally comprise two relatively thin sheets of the insulative material separated by support channels. The cavities between the sheets are filled with foam insulation. Reinforcing rods may also be utilized to pre-load the structure before packing the cargo in the container. The walls, floor, door assemblies, and roof are assembled on the metal structure such that no support surface of the structure extends from inside the container to the outside.

11 Claims, 4 Drawing Sheets

INSULATED SHIPPING CONTAINER

BACKGROUND AND SUMMARY OF THE INVENTION

This invention relates to shipping containers, and, more particularly, to an improved container for shipping refrigerated materials.

Vast quantities of frozen foods, produce, medical supplies, and other materials are shipped in refrigerated transportation containers every year. Traditionally, these containers are constructed of steel support structures with steel floors, walls, and roofs. Steel is generally used so as to provide sufficient strength, support, and rigidity to bear the heavy loads the containers carry and to withstand the rigors of loading and unloading. These containers have several drawbacks. First, because of the weight of the steel and the size of the containers, the weight of the container can easily approach 14,000 pounds. Additionally, steel, like many metals, is a relatively good thermal conductor. Accordingly, containers constructed of all steel components do not insulate very well. This is because the cold air inside the container has an easy path out of the container along the steel components.

In addition to being made of heavy material such as steel, traditional refrigeration containers have utilized traditional refrigeration systems, including compressors and coils, to keep the materials inside the container cold. Such systems have several drawbacks. One of these is that the compressor and other components in the system may break down and need costly or time consuming repairs. Additionally, the systems are run on electricity, and therefore require a source of electricity during transportation.

Accordingly, various non-mechanical refrigeration systems have been attempted. One such system is disclosed in U.S. Pat. No. 4,761,969 to James S. Moe, the present Applicant. This system utilizes a false ceiling inside a shipping container as the cooling chamber. The chamber is charged with liquid $CO_2$, which turns to $CO_2$ snow inside the chamber. As the $CO_2$ sublimates, the vapors are free to travel below the false ceiling and into the cargo carrying compartment of the container, thereby cooling the cargo. In another mode of operation, the $CO_2$ is charged into a bladder in the false ceiling and is vented to the ambient as pressure builds. This keeps the cargo cool without letting it come in contact with the $CO_2$ vapor. Although this system has been found to be very effective in cooling various cargo, when utilized in conjunction with traditional shipping containers it is more difficult to maintain the low temperature because of the poor insulative qualities of the container.

Accordingly, it is an object of the present invention to provide an improved container for shipping refrigerated items.

Another object of the present invention is to provide an improved method for utilizing the cooling system disclosed in U.S. Pat. No. 4,761,969.

Yet another object of the present invention is to provide a refrigerated shipping container that is lighter than traditional containers yet is capable of carrying the same loads.

Still another object of the present invention is to provide a shipping container that may be cooled to the desired temperature by non-mechanical means and maintain that temperature without further charging or use of mechanical means for a longer period of time than traditional containers.

These and other object of the present invention are attained by the provision of an insulated shipping container. The floor, roof, endwall, doors and sidewalls are made from a light, non-metal, highly insulative material. These components generally comprise two relatively thin sheets of the insulative material separated by support channels. The cavities between the sheets are filled with foam insulation. Reinforcing rods may also be utilized to pre-load the structure before packing the cargo in the container. The walls, floor, doors, and roof are assembled on the support structure such that no surface of the support structure extends from inside the container to the outside.

These and other objects and useful features of the present invention will now become evident to those skilled in the art from the following detailed description of the preferred embodiments.

DETAILED DESCRIPTION OF THE PREFERRED EMBODIMENTS

Figure 1:
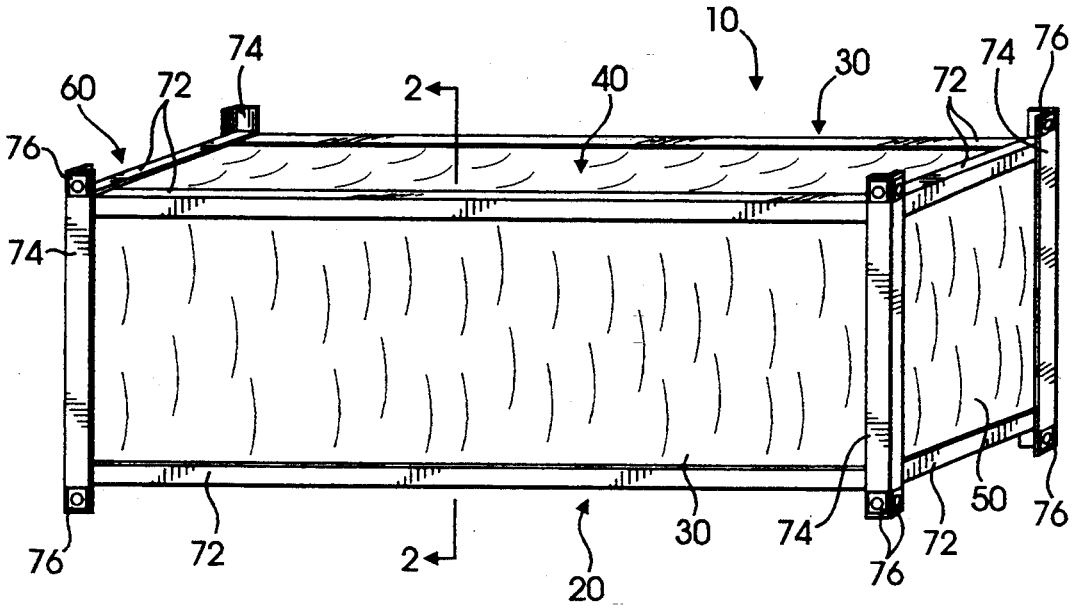
FIG. 1 is a perspective view of a shipping container according to the present invention.

FIG. 1 is a perspective view of a shipping container 10 according to the present invention. Container 10 generally comprises two sidewalls 30, endwall 50, door assemblies 16 (not shown), roof 40, and floor 20 (not shown). Sidewalls 30, endwall 50, doors 60, roof 40, and floor 20 are surrounded by a support structure of angle pieces 72, which are enclosed in four corner posts 74. Angle pieces 72 and corner posts 74 are preferably made from a strong structural material, such as steel. Corner posts 74 also include feet 76 and extend above roof 40 so that similarly constructed containers may be stacked one on top of the other by nesting feet 76 inside the upper portions of corner posts 74. Feet 76 and the portion of corner posts 74 extending above roof 40 are shown as having a generally square cross-sectional configuration. However, any cross-sectional configuration may be used for feet 76 and the upper portion of corner posts 74, so long as they mate properly when the containers are stacked.

Figure 2:
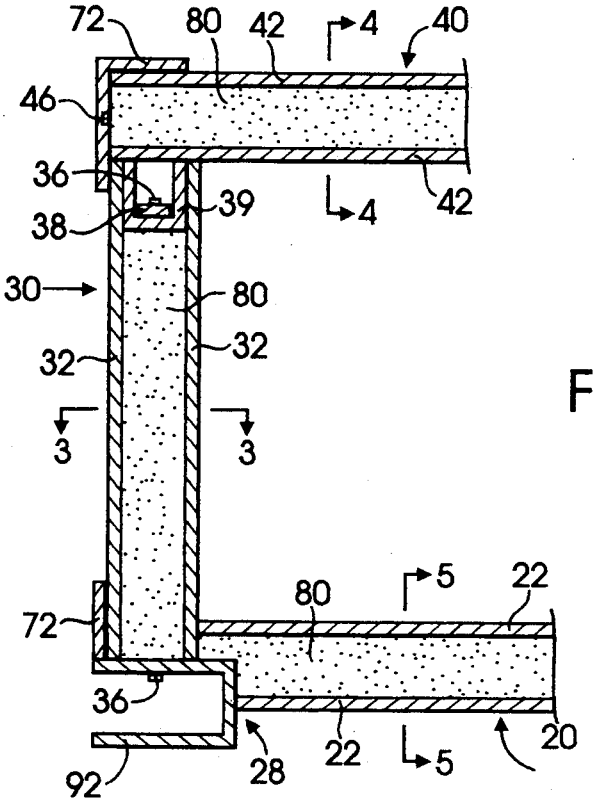
FIG. 2 is a cross-sectional view taken along line 2—2 in FIG. 1.

FIG. 2 shows a cross-sectional view of a portion of container 10 taken along line 2—2 in FIG. 1. From this view, it can be seen that floor 20, sidewall 30, and roof 40 each comprise two opposing skins 22, 32, and 42, respectively. Skins 22, 32, and 42 are made from a relatively strong, lightweight material with relatively poor thermal conductivity. An illustrative material for the skin is a fiberglass and plastic composite known as Azdel, which was developed by General Electric and Pittsburgh Plate and Glass. Each pair of skins is separated by insulating material 80 and other structural members, as will be discussed below.

Figure 3:
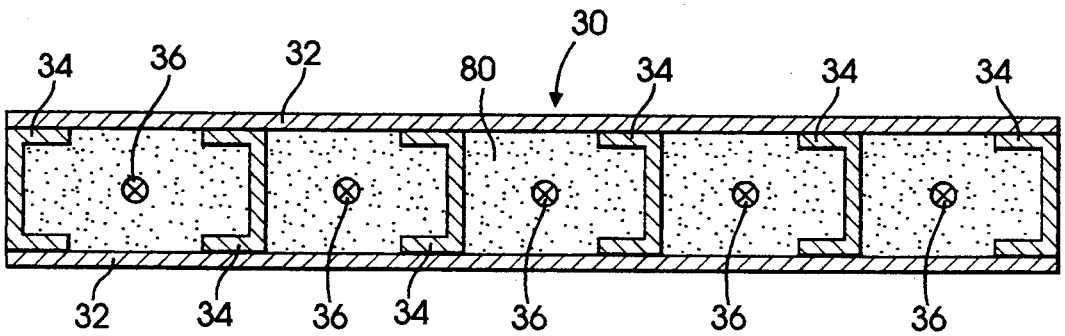
FIG. 3 is a cross-sectional view taken along line 3—3 in FIG. 2.

Turning now to FIG. 3, which is a cross-sectional view taken along line 3—3 in FIG. 2, it can be seen that a plurality of C-shaped channels 34 run longitudinally through sidewall 30 between skins 32. Channels 34 are preferably constructed of the same low thermally conductive materials as skins 32. Channels 34 provide additional strength and rigidity to sidewalls 30. Although channels 34 are shown as generally C-shaped, it should be clearly understood that any configuration which provides the desired strength and rigidity may be utilized. In addition to channels 34, a plurality of reinforcing rods 36 run longitudinally through sidewalls 30 as well. Rods 36 are used in conjunction with plate 38 resting in channel 39 (FIG. 3) to pre-load the structure, as described below.

Figure 4:
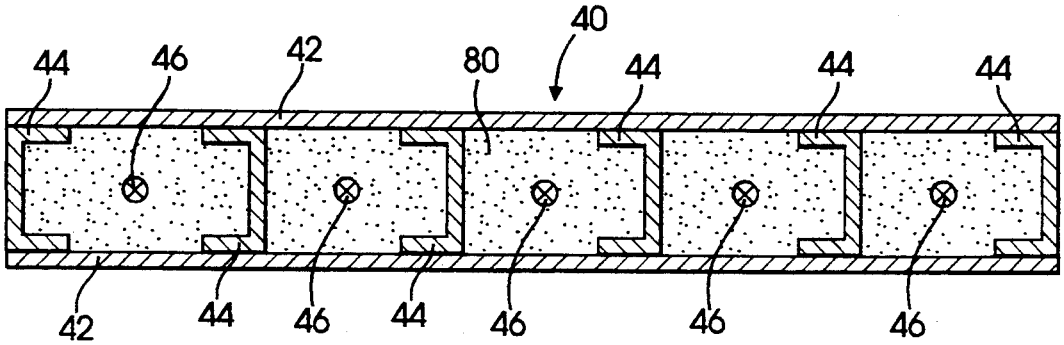
FIG. 4 is a cross-sectional view taken along line 4—4 in FIG. 2.

A similar structure is utilized in roof 40, as can be seen in FIG. 4. FIG. 4 is a cross-sectional view of roof 40 taken along line 4—4 in FIG. 2. Like sidewall 30, roof 40 also has a plurality of C-shaped channels 44 running therethrough, as well as reinforcing rods 46.

Figure 5:
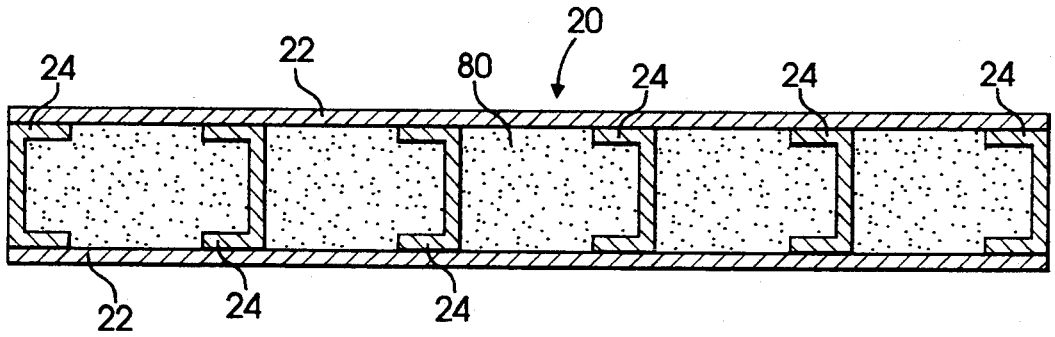
FIG. 5 is a cross-sectional view taken along line 5—5 in FIG. 2.
Figure 6:
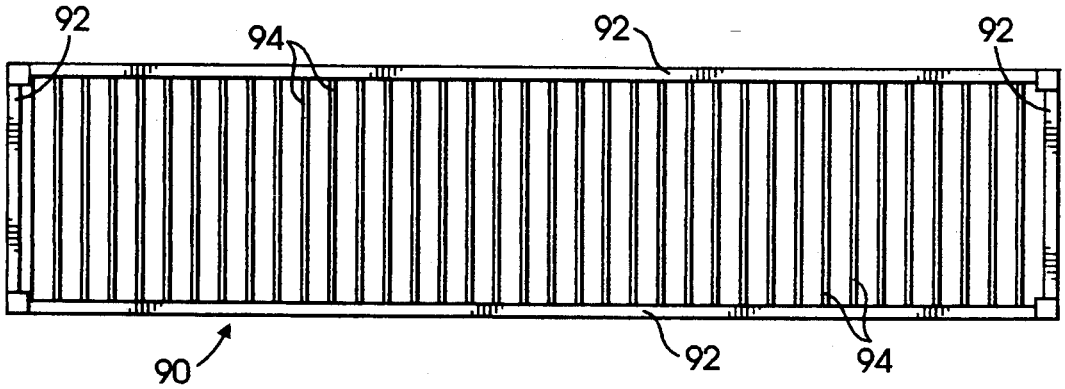
FIG. 6 is a top plan view of a floor support structure for use with a container according to the present invention.

FIG. 5 shows a cross-sectional view of floor 20 taken along line 5—5 in FIG. 2. As with sidewall 30 and ceiling 40, floor 20 also has a plurality of C-shaped channels 24 running therethrough. Floor 20 does not include any reinforcing rods, as do sidewall 30 and ceiling 40. Rather, floor 20 is supported by floor support structure 90, shown in FIG. 6. Floor support structure 90 comprises perimeter floor joists 92 and a plurality of cross-beams 94. Floor support structure 90 is preferably made from the same structural material as angle pieces 72 and corner posts 4.

Figure 7:
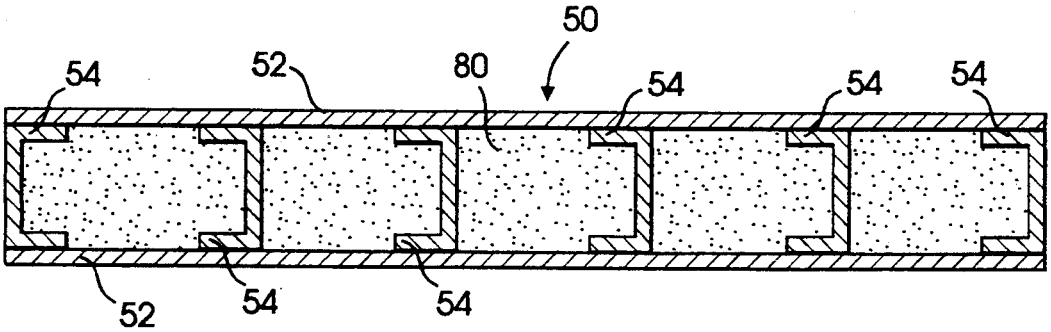
FIG. 7 is a top cross-sectional view of an endwall assembly for a container according to the present invention.
Figure 8:
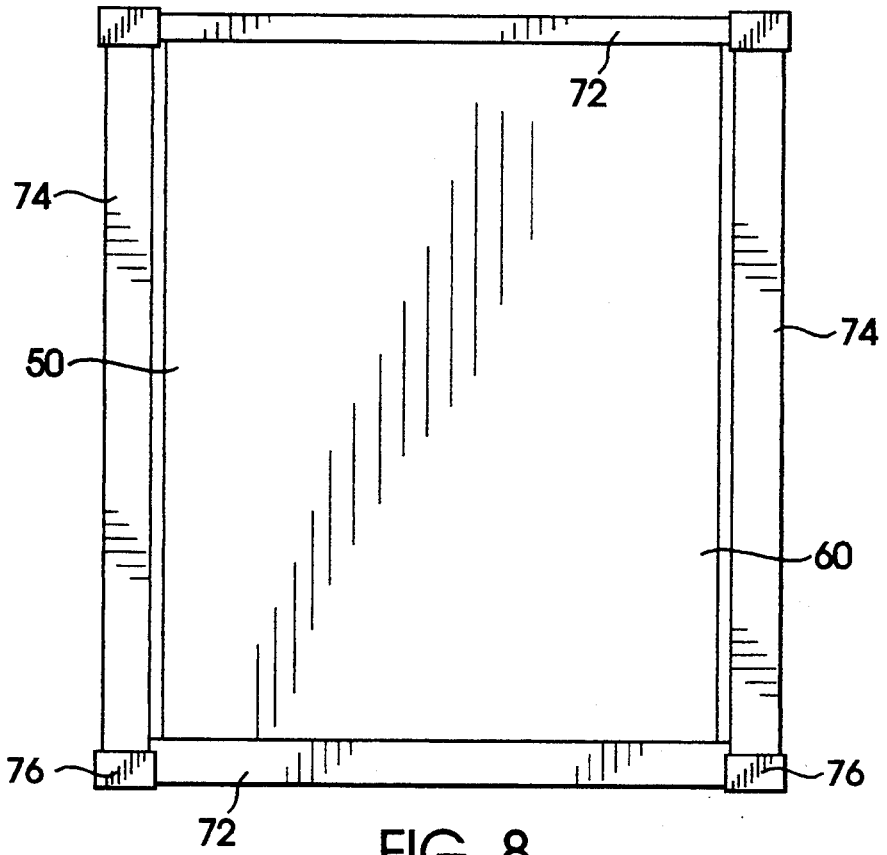
FIG. 8 is an end view of a container according to the present invention.
Figure 9:
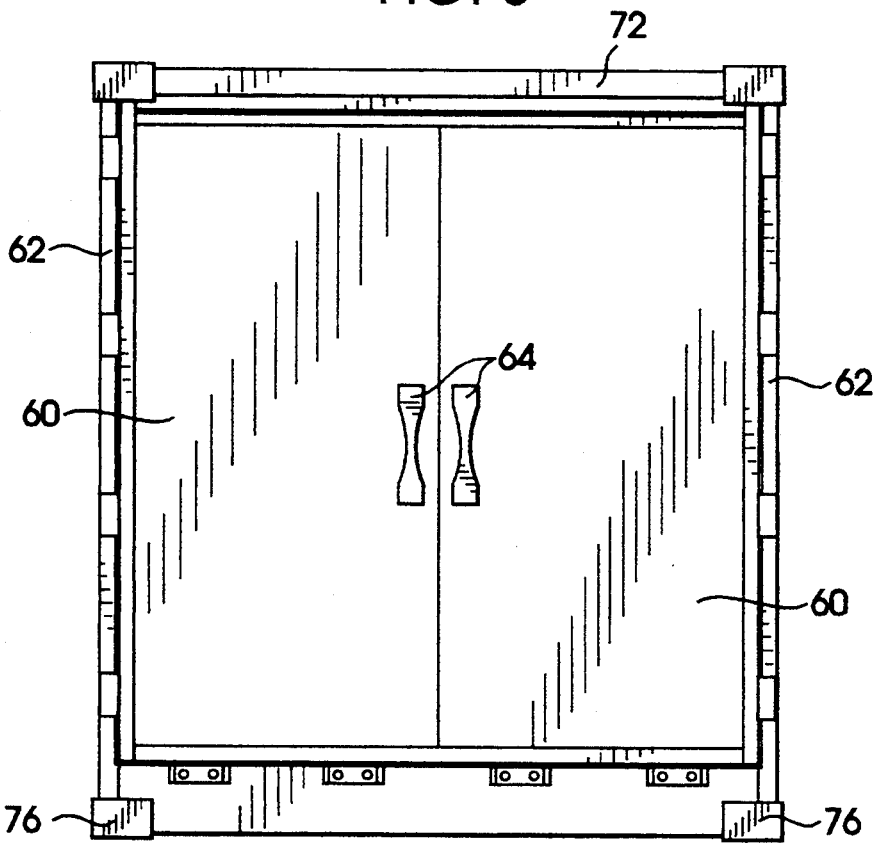
FIG. 9 is an end view of a door assembly for a container according to the present invention.

FIG. 7 shows a top cross-sectional view of endwall 50 of container 10. As with floor 20, endwall 50 contains a plurality of support channels 54, but no support rods. FIGS. 8 and 9 show an end view of container 10 facing endwall 50 and doors 60, respectively. Door assemblies 60 are constructed in the same manner as endwall 50 and further include hinges 62 and handles 64.

To assemble floor 20, one skin 22 is laid on a flat surface and strips of radio frequency tape (RF tape) are placed on skin 22 at the locations where C-channels 24 are to be attached. C-channels 24 are then placed on top of the RF tape, and additional RF tape is placed on top of C-channels 24. A second skin 22 is then placed on top of channels 24, and an RF welder is used to join skins 22 to channels 24 along the length thereof. Insulating foam 80 is then injected in the cavities between channels 24 in floor 20. Any insulating material may be used in the floor and other members of container 10; an illustrative material is polyurethane foam insulation. Sidewalls 30, ceiling 40, and doors 60 are formed by the same method, however, ceiling 40 and sidewalls 30 also have reinforcing rods 36 and 46 inserted in insulating material 80.

To construct container 10, floor support structure 90, lower angle pieces 72, and corner posts 74 are joined to form the majority of the frame for container 10. Floor 20 is then placed over support structure 90 and inside corner posts 74. As can be seen in FIG. 2, floor 20 includes a notch 28 running the length thereof so that floor 20 rests on a portion of perimeter floor joists 92. Sidewalls 30, endwall 50, and doors 60 are then placed within corner posts 74. As can be seen again in FIG. 2, sidewall 30 rests on top of perimeter floor joists 92 such that the interior of sidewall 30 abuts floor 20. Endwall 50 and doors 60 similarly rest on perimeter floor joists 92 and abut floor 20. The bottom end of reinforcing rods 36 in sidewalls 30 are attached, as by welding, to perimeter floor joists 92. Rods 36 are then placed under tension to pre-load the structure and are attached to steel plate 38 at the top of sidewall 30. By placing rods 36 under tension, sidewalls 30 are given greater rigidity. It is anticipated that such reinforcing rods would not be needed in endwalls 50 or door 60 because of their greatly reduced area as compared to sidewalls 30. However, reinforcing rods may be used in any of the components of the container when additional strength and rigidity is desired. Roof 40 is then positioned over sidewalls 30, endwall 50, and doors 60, and upper angle pieces 72 are secured over the top corners. Reinforcing rods 46 in roof 40 are attached to upper angle pieces 72 so as to provide additional support and rigidity.

As assembled, the metal components of container 10—angle pieces 72, corner posts 74, and floor support structure 90—do not intrude into the interior of container 10. This can be more clearly seen in FIG. 2. Note notch 28 in floor 20, which shields floor joist 92 from the interior of container 10. Similarly, Sidewalls 30 abut endwall 50 and doors 60 inside the perimeter of corner posts 74. Because the metal members do not extend from inside container 10 to the outside, container 10 has much greater insulative qualities than traditional containers. This is because skins 22, 32, 42, 52, and 62 (and the C-channels disposed therein) are made from a material with much lower thermal conductivity than metals. Accordingly, once the interior of container 10 has been cooled to the desired temperature, it will maintain that temperature for a longer period of time than conventional containers.

Container 10 can utilize various refrigeration systems. A traditional system may be used, wherein a compressor and refrigeration coils are used to cool the unit. Another illustrative embodiment uses the refrigeration system described in U.S. Pat. No. 4,761,969 to James S. Moe, the present Applicant. The disclosure of U.S. Pat. No. 4,761,969 is hereby explicitly incorporated by reference. To utilize the '969 refrigeration system, a bunker would be installed in the top section of container 10. The supply pipes leading to the manifolds would run from inside the bunker, through inside skin 52 of endwall 50, down through insulating material 80, and through outer skin 52 of endwall 50. The portion of the supply pipes extending above the bunker and the portion extending out endwall 50 would not present sufficient surface area to materially affect the insulative capacity of container 10.

By combining the '969 refrigeration system and the container of the present invention, it is anticipated that food or other items can be kept at temperatures well below freezing by simply charging the container with a cryogenic material, such as $CO_2$. Accordingly, there would be no need for a compressor or other mechanical means to keep the items in the container cold. The need for electricity is similarly eliminated. Instead, the insulative qualities of the container will keep food or other articles frozen for up to thirty days without recharging the system.

Although the invention has been described in detail, it is to be clearly understood that the same is by way of illustration only. Other embodiments of the invention are anticipated. For example, although container 10 is illustrated as a typical size and shape to be shipped by truck, the invention can also be applied to railroad cars, food containers for air service, and containers as small as personal coolers, if so desired. Additionally, the particular configurations of angle pieces 72, corner posts 74, and floor support structure 90 may be varied as desired. Indeed, any shape or configuration will suffice if it is sufficient to hold the insulating walls of the unit together under loading and is constructed such that the structural members do not provide a metal path from inside the unit to the outside. Additionally, it is not necessary to utilize cross-supports 94 to support floor 20. Instead, reinforcing rods can be inserted within floor 20 and attached to perimeter members 92 in a fashion similar to the structure utilized in roof assembly 40. Also, it is anticipated that perimeter members 92 and corner posts 74 can also be constructed from an appropriate composite material.

Although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A container for shipping goods, said container comprising:

a plurality of support posts;

a floor support structure including at least one perimeter member and at least one cross-support;

a floor assembly located on said floor support structure and between said support posts;

a first sidewall and a second sidewall, said first and second sidewalls located between at least two of said support posts and abutting said floor;

a first endwall and a second endwall, said first and second endwalls disposed between at least two of said support posts and abutting said floor and side sidewalls;

a door in said first or second end wall for accessing said container;

a roof assembly disposed on top of said sidewalls and said endwalls and disposed inside said support posts;

at least one perimeter member disposed around said roof assembly and within said support posts;

wherein said floor assembly, sidewalls, endwalls and roof assembly completely shield said floor support structure, support posts, and perimeter members from the interior of said container; and wherein said sidewalls, endwalls, floor assembly and roof assembly each comprises a first skin and a second skin, a plurality of reinforcing channels disposed between said skins so as to form a plurality of cavities, and insulating material disposed within said cavities.

2. A container according to claim 1 further including refrigeration means for initially cooling the interior of said container and the cargo therein.

3. A container according to claim 2 wherein said refrigeration means is non-mechanical.

4. The container of claim 1, further comprising at least one reinforcing rod disposed longitudinally within at least one of said cavities.

5. A container according to claim 4 wherein said skins and said channels are made from a nonmetallic material.

6. A container according to claim 5 wherein said material is Azdel.

7. A container according to claim 6 wherein said support posts, floor support structure, and perimeter members are metal.

8. The container of claim 1, further comprising a false ceiling disposed within said container, a manifold for supplying cryogenic material above said false ceiling, and supply pipes leading from said manifold, through one of said cavities in one of said endwalls, and extending through said endwall to the outside environment.

9. A container for transporting goods, said container comprising:

a plurality of generally vertically extending posts;

a floor support structure comprising perimeter members disposed between said posts so as to form a generally rectangular frame and cross-supports disposed between said perimeter members;

a floor assembly disposed on said floor support structure;

a first endwall and a second endwall, said endwalls disposed between at least two of said posts and abutting said floor assembly;

a first sidewall and a second sidewall, said sidewalls disposed between at least two of said posts and abutting said floor assembly and comprising a first skin, a second skin, a plurality of reinforcing channels disposed between said first and second skins so as to form a plurality of cavities, insulating material disposed in said cavities, a channel disposed on top of said sidewalls with a metal plate disposed therein; and a plurality of reinforcing rods disposed in said cavities;

a roof assembly disposed within said posts and abutting said sidewalls and said endwalls and comprising a first skin, a second skin, a plurality of reinforcing channels disposed between said first and second skins so as to form a plurality of cavities, insulating material disposed in said cavities, and a plurality of reinforcing rods disposed in said cavities;

a top frame structure comprising a plurality of perimeter members disposed within said posts and contacting said roof assembly, sidewalls, and endwalls; and said reinforcing rods in said sidewalls are attached to said perimeter members of said floor support structure and said plate and said reinforcing rods of said roof assembly are attached to said perimeter members of said top frame structure.

10. The container of claim 9 assembled by the method of supporting said floor support structure between said post, placing said floor assembly over said floor support structure and attaching it thereto, placing said endwalls between at least two of said posts and abutting said floor assembly, placing said sidewalls between two of said posts and resting on said perimeter of said floor support structure, attaching said reinforcing rods in said sidewalls to said floor support structure assembly, stressing said reinforcing rods so as to pre-load the structure, attaching said reinforcing rods to said plate, placing said roof assembly over said endwalls and said sidewalls, placing said top frame structure over said roof assembly, and attaching said reinforcing rods in said roof assembly to said top frame structure.

11. A container according to claim 10 further including a false ceiling disposed within said container, a manifold for supplying cryogenic material above said false ceiling, and supply pipes leading from said manifold, through one of said cavities in one of said endwalls, and extending through said endwall to the outside environment.

* * * * *